US005595673A

United States Patent [19]

Ekström et al.

[11] Patent Number: 5,595,673

[45] Date of Patent: Jan. 21, 1997

[54] MICROWAVE OVEN WITH MICROWAVE-ACTUABLE BOTTOM AND TEMPERATURE SENSOR

[75] Inventors: Anders W. Ekström, Norrköping; Bo W. Ohlsson, Kolmården, both of Sweden

[73] Assignee: Whirlpool Europe B.V., Veldhoven, Netherlands

[21] Appl. No.: 489,646

[22] Filed: Jun. 12, 1995

[30] Foreign Application Priority Data

Jun. 13, 1994 [SE] Sweden ..... 9402063

[51] Int. Cl.[6] ..... H05B 6/68

[52] U.S. Cl. ..... 219/710; 219/711; 219/685; 219/759; 99/DIG. 14

[58] Field of Search ..... 219/759, 730, 219/710, 711, 712, 713, 685; 99/325, DIG. 14

[56] References Cited

U.S. PATENT DOCUMENTS

| | | | |
|---|---|---|---|
| 4,125,752 | 11/1978 | Wegener | 219/725 |
| 4,687,895 | 8/1987 | Chitre et al. | 219/759 |
| 4,727,799 | 3/1988 | Ohshima et al. | 219/710 |
| 4,870,235 | 9/1989 | Steers et al. | 219/710 |
| 4,963,709 | 10/1990 | Kimrey, Jr. | 219/712 |
| 5,036,172 | 7/1991 | Kokkeler et al. | 219/710 |

FOREIGN PATENT DOCUMENTS

| | | | |
|---|---|---|---|
| 271419 | 6/1988 | European Pat. Off. | 219/710 |
| 0454143A2 | 4/1991 | European Pat. Off. | H05B 6/68 |
| 0478082A1 | 9/1991 | European Pat. Off. | H05B 6/64 |
| 0478053A1 | 9/1991 | European Pat. Off. | H05B 6/74 |
| 0529644A2 | 8/1992 | European Pat. Off. | H05B 6/68 |
| 0573750A2 | 3/1993 | European Pat. Off. | H05B 6/70 |

*Primary Examiner*—Philip H. Leung

*Attorney, Agent, or Firm*—Stephen D. Krefman; Mark A. Davis

[57] ABSTRACT

A microwave oven comprises a microwave radiation source, a microwave-activable bottom heater (4) on which the food is placed, and optionally an IR-radiating top heater, which all can be controlled via the control unit of the oven. Further, the oven comprises one or more sensors for sensing the temperature of the bottom heater (4) and feeding this information back to the control unit. The feedback temperature information makes it possible to impart the desired temperature to the bottom heater (4) by controlling the microwave radiation source and/or the top heater.

12 Claims, 3 Drawing Sheets

MICROWAVE OVEN WITH MICROWAVE-ACTUABLE BOTTOM AND TEMPERATURE SENSOR

This invention relates to a microwave oven comprising a cavity, a microwave radiation source for feeding microwaves to the cavity, a microwave-activable bottom heater in the form of a receptacle, a plate or a carrier on which food is placed for heating or cooking, and a control unit for controlling the bottom heater and the feeding of microwaves to the cavity.

The microwave radiation source and the associated microwave-feed system generate a microwave distribution in the oven cavity that brings about so-called volume heating of the food.

The microwave oven may comprise an additional source of heat for the food in the form of a microwave-activable, so-called crisp or browning plate. A crisp plate may consist of an aluminium plate which has small thermal mass and good thermal conductivity and on whose underside is provided a microwave-absorbing layer. SE Patent Specification 9003104-8 discloses such a crisp plate. A browning plate has greater thermal mass and may consist of a plate of ceramics or glass provided with a microwave-absorbing layer. In general, both the crisp plate and the browning plate are arranged to rotate during cooking or heating.

The microwave oven may have yet another source of heat in the form of a so-called grill element or an equivalent IR-radiation element, which usually is arranged in the ceiling of the cavity (see, for instance, SE Patent Specification 9201786-2).

A microwave oven equipped with these three types of heat sources basically has access to a volume heater, a bottom heater and a top heater, in which case the heat emission from the two former is controlled by regulating the microwave feed to the cavity, and the latter is controlled directly as regards activation time and power level. In order to optimise the heating or cooking of a specific type of food, the three heat sources have to be used in an appropriate manner, i.e. be activated at adjusted power levels for a suitable period of the cooking or heating procedure. However, the problem is that the activation times and power levels for different sorts of food vary considerably. For the average user, this is much too complicated, and he therefore is usually not given the opportunity to control the cooking or heating procedure in this fashion. Microwave ovens are instead so constructed that there is only one power balance, determined by the manufacturer, between the different sources of heat.

In some countries, the power consumption of apparatus with single-phase connection is restricted, which among other things means that the microwave radiation source and the grill element cannot be activated at the same time. In turn, this places special requirements on the utilisation of the heat sources depending on the type of food at issue, and tends to complicate matters further for the user.

Automatic and user-friendly methods for controlling such a microwave oven with several heat sources are disclosed in the applicant's Patent Applications 9402062-5 and 9402061-7 with the same filing date as the present application. These methods make it possible to use the different heat sources of the microwave oven in such a manner as to improve the cooking or heating results, while enabling the microwave oven to be used for cooking or heating such food and dishes as today may only be heated in a conventional oven, e.g. deep-frozen ready-cooked chicken parts that are to retain their crispiness.

Conveniently, the microwave activation of the bottom heater is performed in the manner described in the above SE Patent Specification 9003104-8, while using a microwave oven equipped with a microwave-feed system described in more detail in SE Patent Specification 9003012-3. The control of the feeding of microwaves to the bottom heater may be further improved by using a microwave-feed system which has several feed openings to the cavity and is of the type described in SE Patent Specification 9302302-6.

The object of the invention is to improve, in a microwave oven of the type described by way of introduction, the control of the heat emission to the food from the active heat sources of the oven, i.e. the direct-acting microwaves, the bottom heater and, optionally, a top heater in the form of a grill element or an equivalent IR-radiation element.

According to the invention, this object is attained by a microwave oven which is of the type described by way of introduction and is characterised in that means are arranged for sensing a parameter related to the temperature of the microwave-absorbing bottom heater, and that the control unit is arranged to receive the sensing parameter and, depending on the value thereof, control the feeding of microwaves to the cavity, and hence the microwave power supplied to the cavity during a cooking or heating procedure.

The invention has the advantage of providing feedback control of the temperature of the bottom heater, which enables a more well-defined and more rapid heating procedure. When heating a considerable load, one notices almost at once that the temperature of the bottom heater or crisp plate increases too slowly, and one may then increase the microwave power supplied as a function of the temperature sensed. Also, the temperature of the crisp plate can be maintained on an essentially constant level, e.g. at a lower temperature than normal, which may be suitable when cooking certain types of dishes.

A preferred embodiment of the inventive microwave oven is characterised in that the temperature-sensing means comprises a plate which is made of a microwave-absorbing material which may be of the same or a similar type as that of which is made the microwave-absorbing layer on the underside of the bottom heater. This "sensing plate" or sensor is conveniently disposed at the bottom of the cavity, and its temperature can be sensed by means of e.g. a thermoelement or an IR sensor.

In a further development of the oven, several such "sensing plates" or sensors may be provided along a radius of the bottom heater or crisp plate, when the oven is equipped with a rotary crisp plate. Such an arrangement enables the temperature to be sensed in several places on the crisp plate, which is advantageous when cooking food which covers only a minor part of the crisp plate, since the plate will then have a comparatively lower temperature in parts closer to the food.

Further distinctive features of the microwave oven according to the invention are stated in the appended claims.

A non-restricting embodiment of the invention will now be described in more detail with reference to the accompanying drawings, in which FIG. 1 shows an inventive microwave oven whose door is open;

Figure 1:
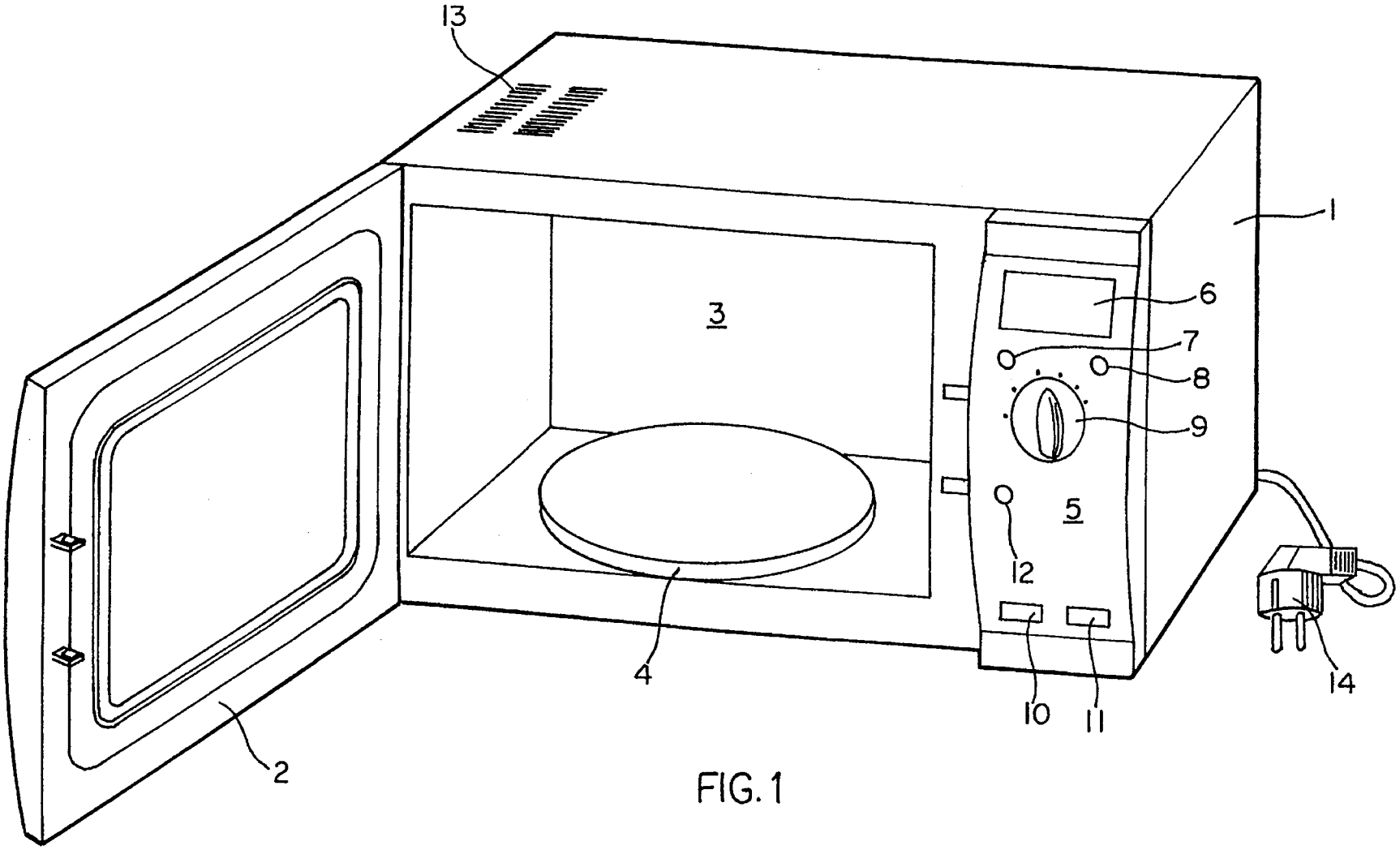

The microwave oven illustrated in FIG. 1 has an external casing 1, and an oven door 2 for closing the cavity 3, in which a crisp plate 4 is arranged. The crisp plate 4 is made of sheet aluminium of small thermal mass and good thermal conductivity, and its underside is provided with a microwave-absorbing layer of rubber-embedded ferrite. Preferably, the ferrite material employed has a Curie point at which ceases the layer's energy absorption from the microwaves, which means that the temperature of the upper side of the crisp plate that comes into contact with the food stabilises in a temperature range of 130°–230° C. The crisp plate is adapted to rotate during the cooking or heating procedure. SE Patent Specification 9003104-8, as well as the applicant's microwave ovens of type designations VIP20 and VIP27, illustrates a more detailed construction of the crisp plate as well as its rotary mechanism.

Figure 2:
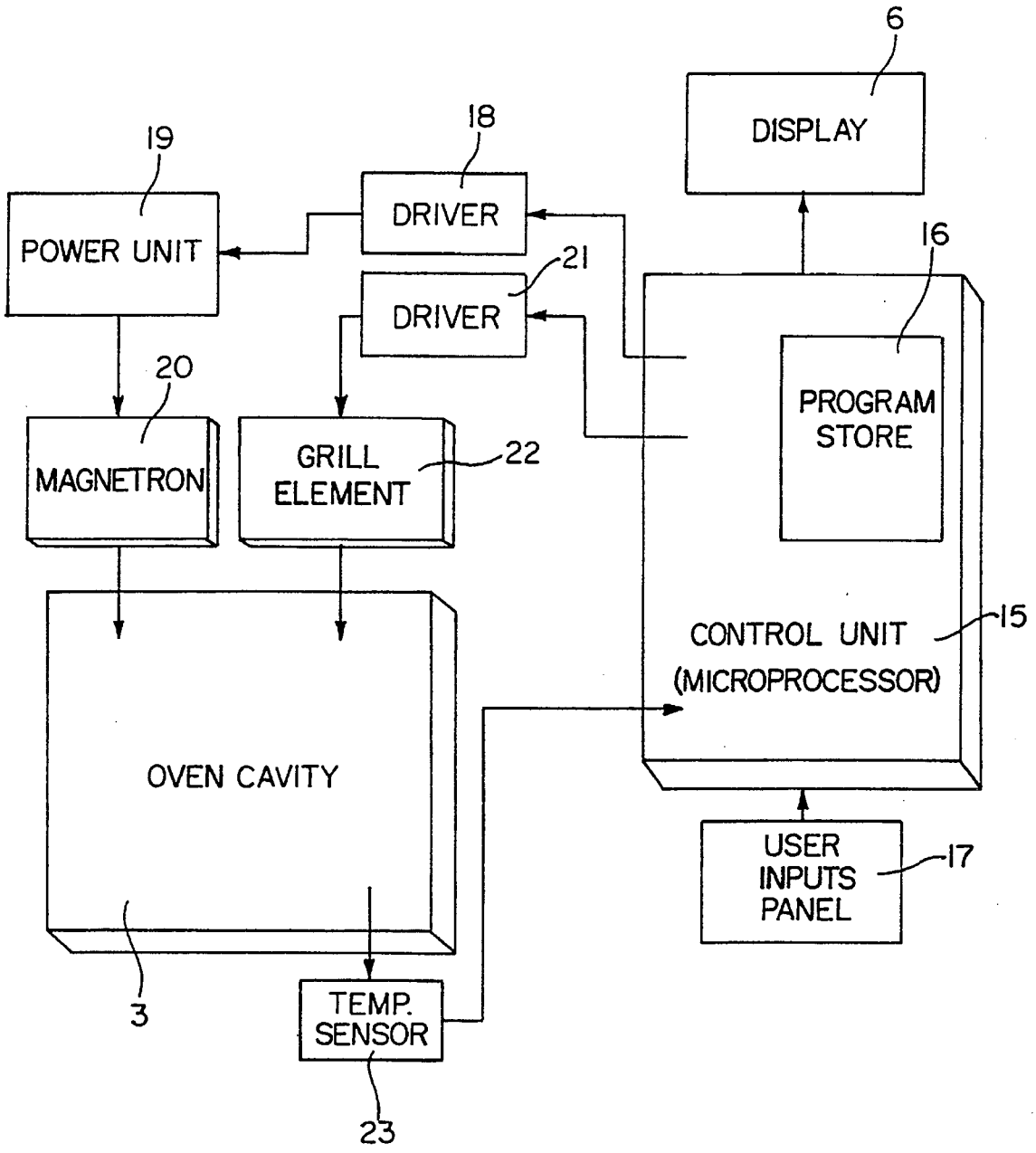
FIG. 2 is a block diagram illustrating cooperating functional units of the oven controlled through temperature sensing in accordance with the invention.

The microwaves are fed to the cavity via one or more feed openings (not shown) which communicate via waveguides with the microwave radiation source 20 (normally a magnetron) of the oven (see FIG. 2). In the illustrated oven, the magnetron, the associated waveguide system, the power unit 19 for operating the magnetron, and the control unit 15 are disposed behind the control panel 5. In a preferred embodiment of the microwave-feed system, use is made of an upper and a lower feed opening, which are provided in the right-hand lateral wall of the cavity 3, whereas the remainder of the feed system is designed to feed polarised microwaves through these openings. For more detailed information on the construction of the microwave-feed system, reference is made to SE Patent Specification 9003012-3, as well as to the applicant's microwave ovens mentioned in the foregoing.

A grill element (not shown) is arranged in the ceiling of the cavity, e.g. in the manner described in SE Patent Specification 9201786-2 mentioned above. The grill element may be a so-called "grill tube", a quartz tube or a halogen-radiation source. Instances of concrete designs are found in the applicant's microwave oven of type designation VIP20.

The control panel 5 has a display 6 which, controlled by the control unit 15, shows, among other things, symbols or plain-text messages for selected programs, and the remaining cooking or heating time, i.e. verifies the user's selections made via the control panel as well as provides other information on how the cooking or heating proceeds.

The control button 7 is used for selecting heating through the feeding of microwaves to the cavity. The button 8 is used for activating the grill element of the oven, and the desired time is set by the knob 9. These basic options have their equivalence in a conventional oven and supplement the inventive option to select from a given number of preprogrammed cooking or heating programs for specific types of food while utilising the interplay of the direct-acting microwaves, the crisp plate and the grill element. When using only direct-acting microwaves for conventional heating, the removable crisp plate can be replaced with an ordinary rotary bottom plate. When using preprogrammed programs, the desired temperature of the crisp plate can be set by the knob 9.

The buttons 10 and 11 are provided for, respectively, starting and switching off the oven. The control button 12 serves to input food-category information and, hence, to select a preprogrammed cooking or heating program for a specific dish, such as deep-frozen pizza. The food-category information supplied by operation of the button 12 involves information on the type of food as well as its initial state. All the buttons, as well as the knob and the display, are in communication with the control unit 15.

On the upper side of the oven, there are provided ventilation holes 13 communicating with the evacuation channel (not shown) of the cavity that is disposed in the space between the ceiling or side of the cavity and the external casing 1. A temperature sensor as well as a sensor capable of sensing substance emission from the food, humidity, gas, etc. can be arranged in the evacuation channel to control the oven in the manner described in Patent Application 9402061-7 having the same filing date as the present application. In view of single-phase connection to the mains, the oven has a flex 14 with a plug.

The block diagram of FIG. 2 shows the control unit 15 and a microprocessor and its associated program store 16. The user information is inputted to the control unit via the block 17, which represents the control buttons and the knob described above. The control unit controls the display 6. Via a driver 18 and a microwave power unit 19, the control unit 15 controls the microwave radiation source 20, and hence the feeding of microwaves to the cavity 3. Via a driver 21, the control unit 15 controls the grill element 22, and hence the IR radiation fed to the cavity 3. From the cavity, information is fed back to the control unit 15 by a temperature sensor 23 or several temperature sensors 23, 24, 25 (see FIG. 3) for sensing the temperature of the crisp plate 4. Through the feedback information from the temperature sensor or sensors, the control unit 15 controls not only the microwave feed from the microwave radiation source but also the IR radiation from the grill element and, hence, the temperature of the crisp plate. For more detailed information on the construction of these functional units, reference is made to the above-mentioned patents as well as to the microwave ovens manufactured by the applicant.

Figure 3:
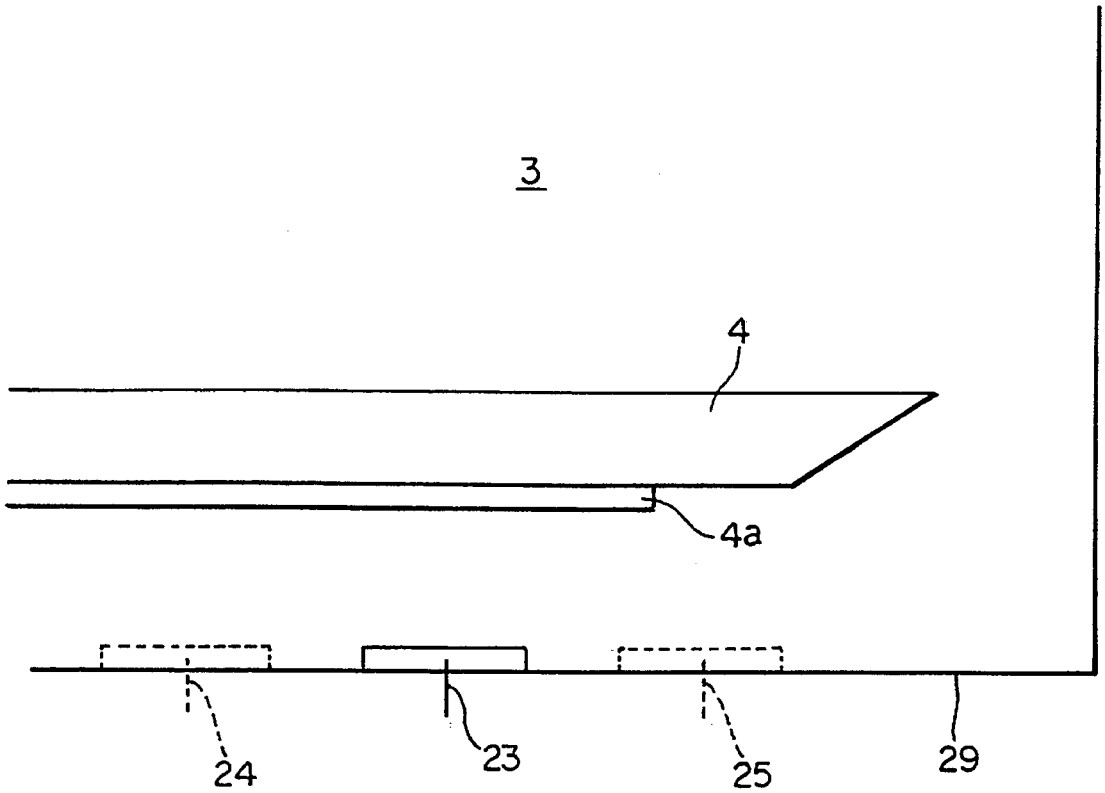
FIG. 3 illustrates schematically the arrangement of a crisp plate and one or more temperature sensors.

FIG. 3 illustrates schematically part of the cavity 3 with the cavity wall 29 and the crisp plate 4 which is arranged therein and which, on the underside, is provided with a microwave-absorbing ferrite layer 4*a*. By using a microwave-feed system as described in SE Patent Specification 9003012-3, which has a feed opening on a level with the crisp plate, polarised microwaves, whose E-vector is substantially parallel to the plane of the ferrite layer 4*a*, are supplied. As a result, the layer 4*a* is chiefly heated by resistive losses generated through induced currents in the layer, which in turn heats the crisp plate. Alternatively, the fed microwaves may have such a polarisation that their H-vector is substantially parallel to the layer 4*a*, which means that the layer 4*a* is mainly heated through magnetic interaction of the layer and the microwaves.

A temperature sensor 23 is arranged on the bottom of the cavity to sense a measured value representative of the temperature of the crisp plate. In a further development of the oven, several temperature sensors, for instance three sensors 23, 24, 25, may be arranged to sense the temperature in different places on the crisp plate 4. Preferably, the temperature sensors are arranged along a radius of the rotary crisp plate.

Figure 4:
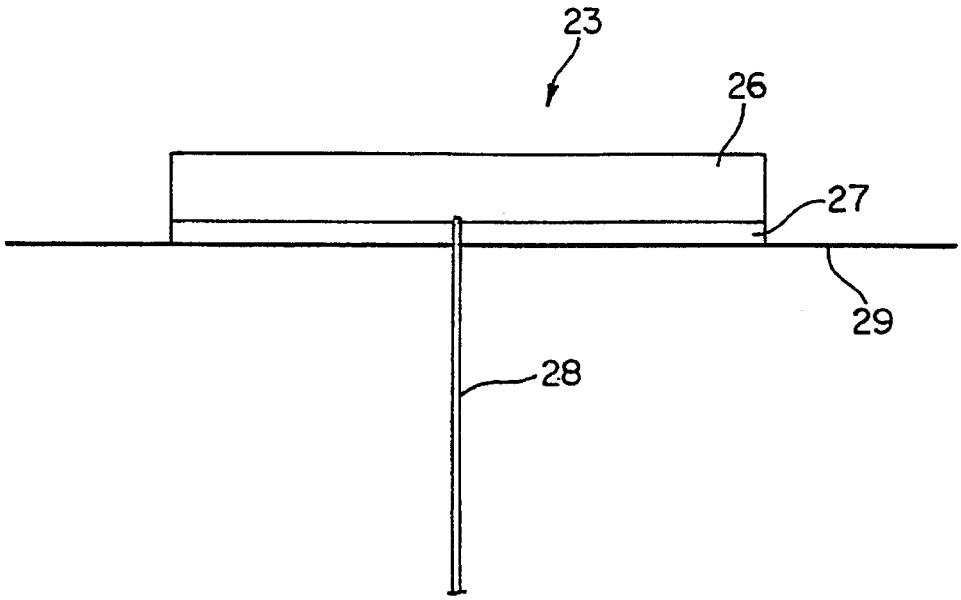
FIG. 4 shows a temperature sensor in FIG. 3 on a larger scale.

FIG. 4 illustrates a preferred embodiment of the temperature sensor 23 in FIG. 3. The sensor includes a ferrite plate 26 resting on a heat-insulating layer 27, which in turn is applied against the bottom 29 of the cavity. A thermoelement 28 is in contact with the ferrite plate 26 via a lead-through in the bottom 29 of the cavity and the heat-insulating layer 27. The thermoelement 28 communicates with the control unit 15, as shown in FIG. 2. Alternatively, the thermoelement 28 may be replaced with a temperature-sensitive resistor of PTC or NTC type.

The microwaves in the space beneath the crisp plate heat the layer 4*a*, as well as the ferrite plate 26. Preferably, the plate 26 is made of the same ferrite material as the plate 4*a*, but another ferrite material may also be used. What is essential is that the temperature of the ferrite plate 26 has a known relation to the temperature of the crisp plate 4, so that the temperature of the plate 26 may be used as an indication of the temperature of the crisp plate.

The thermoelement shown in the drawings may be replaced with an IR sensor for sensing the temperature of the plate 26. If so, the IR sensor is suitably disposed beneath the bottom of the cavity and senses the temperature of the plate 26 via a hole in the bottom 29 of the cavity and the heat-insulating layer 27. Alternatively, the temperature of the crisp plate 4 may be sensed directly by an IR sensor disposed beneath the bottom of the cavity and receiving, via a hole in the bottom of the cavity, IR radiation from the crisp plate 4 and/or the microwave-absorbing layer 4*a*. The choice of IR sensor and its position and the choice of diameter of the hole in the bottom of the cavity in view of avoiding a microwave leak are but measures of convenience and will therefore not be described in more detail here.

It will be appreciated that those skilled in the art are well qualified to devise further developments of and alternatives to the described arrangement of the temperature sensor or sensors, as well as their type and/or construction. Thus, the described IR sensor may be positioned elsewhere than beneath the bottom of the cavity, for instance adjacent to a lateral wall or the ceiling of the cavity. In one embodiment, the temperature of the edge of the crisp plate is sensed by one or more IR sensors provided adjacent to the lateral wall of the cavity on a level with the crisp plate. If higher reliability in the temperature sensing is desired, sensing by e.g. a thermoelement is conveniently combined with sensing by an IR sensor.

We claim:

1. A microwave oven comprising a cavity, a microwave radiation source for feeding microwaves to the cavity, a microwave-activable bottom heater in the form of a receptacle and comprising a microwave-absorbing material, a carrier for receiving food for heating or cooking, and a control unit for controlling the bottom heater and the feeding of microwaves to the cavity, characterized in that a temperature sensor is disposed in the cavity out of physical contact with the bottom heater, the temperature sensor comprises microwave-absorbing material whose temperature is related to the temperature of the bottom heater, and sensed by the sensor, and the control unit is arranged to receive the sensed temperature and, depending on the value thereof, control the feeding of microwaves to the cavity during a cooking or heating procedure.

2. A microwave oven as set forth in claim 1, characterised in that the parameter-sensing means comprises an IR sensor adapted to sense IR radiation from the bottom heater (4).

3. A microwave oven as set forth in claim 1, in which the bottom heater comprises a rotary crisp plate (4) which is of metal and has small thermal mass and good thermal conductivity and whose underside is provided with a microwave-absorbing ferrite layer (4*a*), characterised in that the parameter-sensing means (23, 24, 25) are adapted to sense, in several places along the radius of the crisp plate, parameters related to the temperature of the crisp plate (4).

4. A microwave oven as set forth in claim 1, which further comprises a grill element or some other equivalent IR-radiation element whose radiant power and activation time can be controlled via the control unit (15), characterised in that the control unit is adapted to use information on the temperature of the bottom heater (4) for controlling the emission of radiation from the IR-radiation element.

5. A microwave oven as set forth in claim 1, characterized in that the microwave-absorbing material of the bottom heater and the sensor are of the same type.

6. A microwave oven as set forth in claim 5, characterised in that the plate (26) is disposed adjacent to the bottom (29) of the cavity.

7. A microwave oven as set forth in claim 5, characterized in that the bottom heater has a layer of microwave-absorbing material and the sensor has a plate of microwave-absorbing material.

8. A microwave oven as set forth in claim 7, characterised in that the microwave-absorbing material is ferrite.

9. A microwave oven as set forth in claim 7, characterised in that the plate (26) bears on the bottom (29) of the cavity by the intermediary of a heat-insulating layer (27).

10. A microwave oven as set forth in claim 9, characterised in that the temperature of the plate (26) is sensed by means of a sensing element (28), which is adapted to be in thermal contact with the plate (26) via lead-throughs in the heat-insulating layer (27) and the bottom (29) of the cavity.

11. A microwave oven as set forth in claim 9, characterised in that the temperature of the plate (26) is sensed via holes in the heat-insulating layer (27) and the bottom (29) of the cavity by means of an IR sensor located beneath the bottom (29).

12. A microwave oven as set forth in claim 1, characterized in that one of the bottom heater and carrier rotates during the heating or cooking operation.

* * * * *